US005810023A

United States Patent [19]

Jones et al.

[11] Patent Number: 5,810,023

[45] Date of Patent: Sep. 22, 1998

[54] METHOD FOR STYLING HAIR USING A FLAT DISK

[75] Inventors: Marla Vanessa Jones, New York; Angela Ferguson, Brooklyn, both of N.Y.; Pat Grant Williams, Silver Spring, Md.

[73] Assignee: Revlon Consumer Products corporation, New York, N.Y.

[21] Appl. No.: 640,215

[22] Filed: Apr. 30, 1996

[51] Int. Cl.[6] ..... A45D 7/04

[52] U.S. Cl. ..... 132/207; 132/245; 132/273

[58] Field of Search ..... 132/207, 210, 132/200, 209, 268, 245, 273, 281; 369/270, 290, 289

[56] References Cited

U.S. PATENT DOCUMENTS

| | | | |
|---|---|---|---|
| 1,504,791 | 8/1924 | Siegel | 132/245 |
| 2,393,376 | 1/1946 | Holden . | |
| 2,397,908 | 4/1946 | Altman | 132/245 |
| 2,404,867 | 7/1946 | Simons . | |
| 2,513,097 | 6/1950 | Klotkowski | 132/245 |
| 2,590,166 | 3/1952 | Farrell . | |
| 2,619,351 | 11/1952 | Kennedy | 369/270 |
| 2,712,943 | 7/1955 | Morrison | 369/290 |
| 2,871,866 | 2/1959 | Papandrea . | |
| 3,247,856 | 4/1966 | Weeks . | |
| 5,261,428 | 11/1993 | Wu . | |
| 5,277,206 | 1/1994 | Rose et al. | 132/204 |
| 5,318,054 | 6/1994 | Neilson . | |

FOREIGN PATENT DOCUMENTS

| | | | |
|---|---|---|---|
| 758742 | 1/1934 | France | 132/245 |
| 1408735 | 4/1964 | France . | |
| 2631527 | 11/1989 | France . | |
| 3008162 | 9/1981 | Germany . | |
| 8908867 | 7/1989 | Germany . | |
| 518 | of 1887 | United Kingdom . | |
| 18662 | of 1891 | United Kingdom . | |
| 0001815 | of 1895 | United Kingdom . | |

*Primary Examiner*—Todd E. Manhan
*Assistant Examiner*—Eduardo C. Robert
*Attorney, Agent, or Firm*—Julie Blackburn

[57] ABSTRACT

A method for styling hair using a hair styling device which comprises a flat disk made of a flexible plastic material. The flat disk has a central core with an aperture of a size sufficient to permit a tress of hair to be pulled through it, and a plurality of arms radiating from the core. The tress of hair pulled through the aperture is then wound through the plurality of arms in a desired configuration.

7 Claims, 3 Drawing Sheets

METHOD FOR STYLING HAIR USING A FLAT DISK

TECHNICAL FIELD

The invention is the in field of devices used to style hair.

BACKGROUND OF THE INVENTION

Hair may be permanently or temporarily styled by many different methods. Permanent styling of hair refers to the permanent deformation of hair achieved by breaking the disulfide bonds in the hair and reforming them in the desired configuration. Examples of compositions capable of causing permanent deformation of hair are permanent waving compositions, hair relaxers, and so on. Temporary styling of hair is generally accomplished by applying styling compositions such as hairspray, mousse, hair gel, etc. to wet hair which is arranged in the desired configuration and allowing the hair to dry. The temporary set remains until hair is washed. Curlers, rollers, hairpins, and the like are all common devices used in both permanent and temporary styling of hair.

It is known in the art to use records disks in the temporary or permanent styling of hair. Record disks are small plastic pieces used as insets to enable the playing of 45 rpm records on a 33 rpm turntable. The problem with record disks, however, is that they are too small and the arms which protrude from the core of the disk are so close to the core that a tress of hair cannot be pulled through the slit formed between the core and the arm unless the tress comprises only a few strands of hair. Thus, when record disks are used the tress of hair is generally drawn through the central aperature of the disk and wound around the outer edge of the disk rather than through the arms. Furthermore, the disks themselves have sharp edges which cause increased breakage and damage of hair.

Wavy hair styles are becoming increasing popular, particularly with African-American women who desire to obtain a unique effect with relaxed or straightened hair. However, such wavy hairstyles are not easily achieved with the devices which are currently available.

Accordingly, there is a need for better hair styling devices, particularly those which provide the wavy hair phenonmena. In particular, there is a need for hair styling devices that can be used with compositions which temporarily or permanently deform hair to provide wavy hair.

SUMMARY OF THE INVENTION

The invention is directed to a hair styling device comprising a flat disk having a central core and a plurality of arms radiating therefrom, wherein said central core contains an aperature of size sufficient to permit a tress of hair to pass therethrough.

The invention is also directed to a method for styling hair with a hair styling device comprised of a flat disk having a central core and a plurality of arms radiating therefrom, wherein said central core contains an aperature of a size sufficient to permit a tress of hair to pass therethrough, comprising the steps of:

a) pulling a tress of hair through the aperature of said central core, b) winding said tress through the arms radiating from said central core in the desired configuration, c) leaving the device in the hair for a period of time sufficient to cause the hair to conform to the desired configuration.

DETAILED DESCRIPTION

Figure 3:
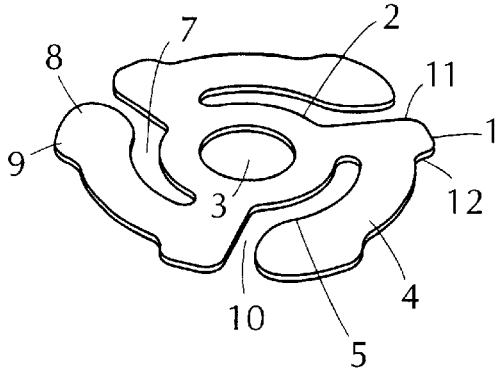
FIG. 3: illustrates the hair styling device of the invention.

Referring to FIG. 3, the hair styling device of the invention 1 is a flat disk of a generally circular configuration and preferably made of a flexible plastic material, although the disk may be rectangular, square, octagonal, or the like. Generally, the disk can be inscribed in a cylinder having dimensions of 1 to 6 inches, more preferably 1 to 4, most preferably 2 inches. The disk contains a central core 2 having an aperature 3 of a diameter sufficient to permit a tress of hair to be pulled therethrough. Preferably the aperature will have a diameter of 0.25 to 0.75 inch, more preferably about 0.5 inch. A plurality of arms 4 radiate from the central core. Preferably the disk contains three arms radiating from the central core. The term "arm" means that the arm is attached to the central core of the disk at one place only, which is referred to herein as the "shoulder", thus distinguishing the device of the invention from the prior art record disk depicted in FIG. 9. Preferably the arms radiate from the central core at an angle and position sufficient to cause a slit 5 to form between the inner surface 6 of the arm and the outer surface 7 of the central core 2. The slit 5 preferably has a width of about 0.0625 to 0.50 inch, more preferably 0.0625 to 0.25 inch. The free end 8 of the arm 4, may be shaped to contain a slight bulge or protrusion 9 toward the free end 8 which will cause the slit 5 to narrow slightly 10 prior to opening at the outside of the device. Preferably, the arm diverges from the central core in the form of a straight line forming a shoulder 11 at about a 90 degree angle from the central core. Preferably there is a slight indentation 12 as the shoulder 11 merges into the arm 4 forming a recessed area 13 between the shoulder 11 and the bulge or protrusion 9 at the free end 8 of the arm 4. The recessed area 13 provides an area for the tress to rest as it is pulled through the arms and around the periphery of the device.

Figure 2:
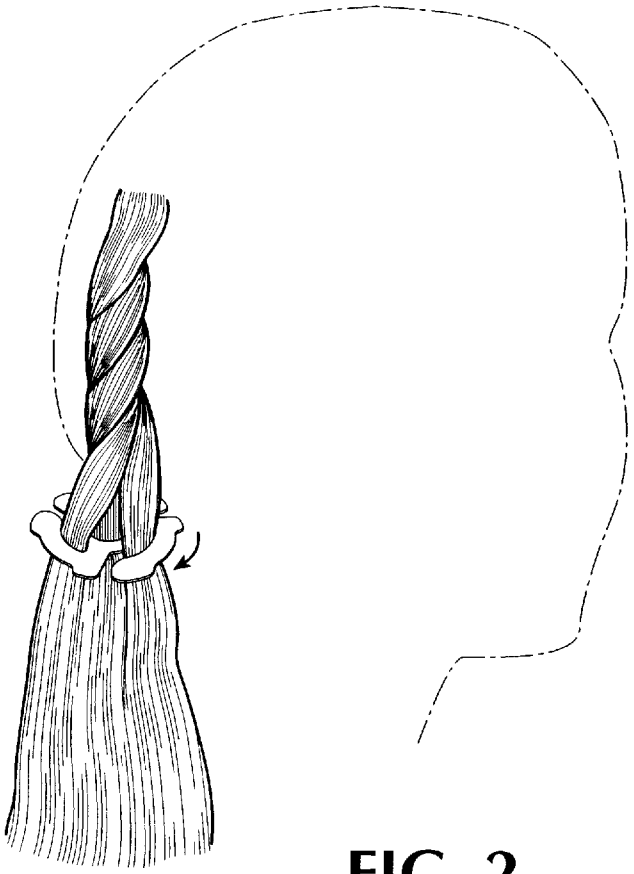
FIG. 2: shows one method by which the hair styling device of the invention can be used to provide a braid-like appearance to a hair tress.
Figure 1:
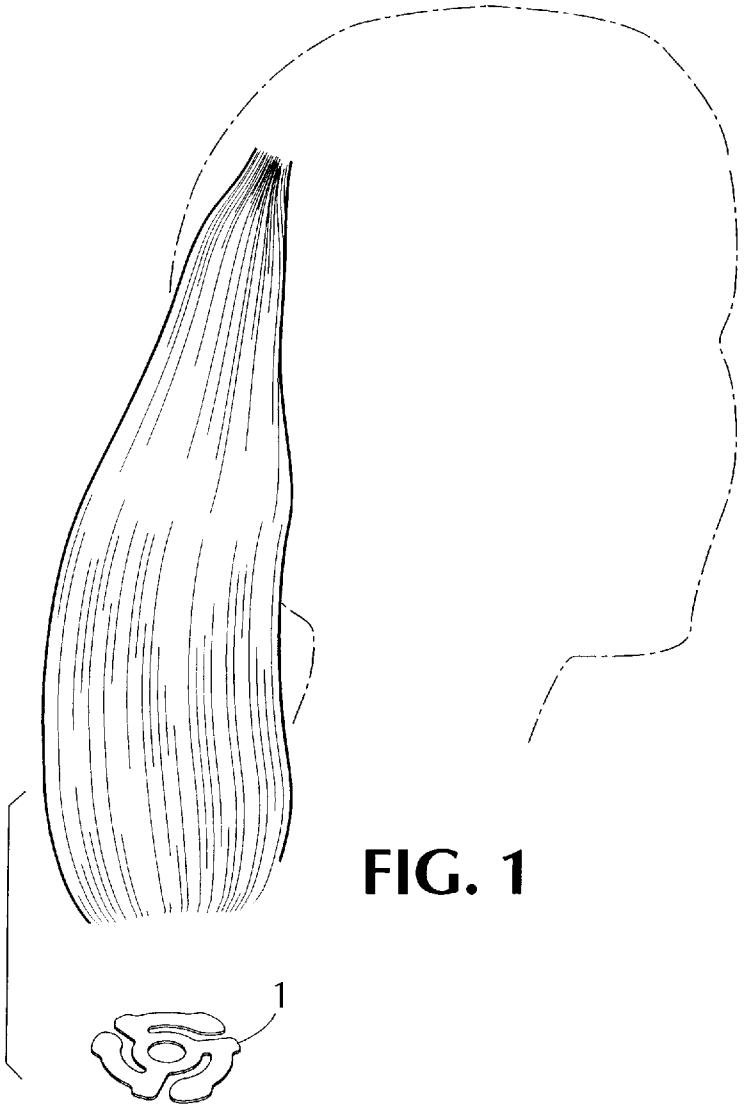
FIG. 1: shows the hair styling device of the invention prior to incorporation into a subject's hair tress.
Figure 4:
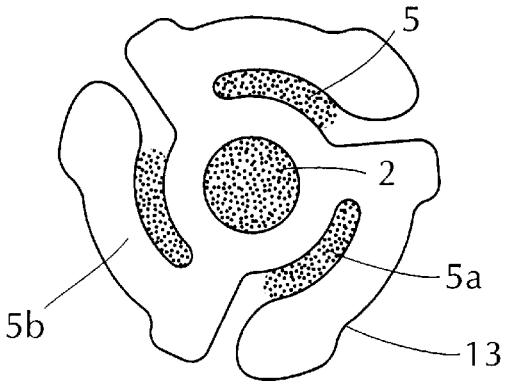
FIG. 4: illustrates how the hair tress as illustrated in FIG. 2 is threaded into the hair styling device.
Figure 5:
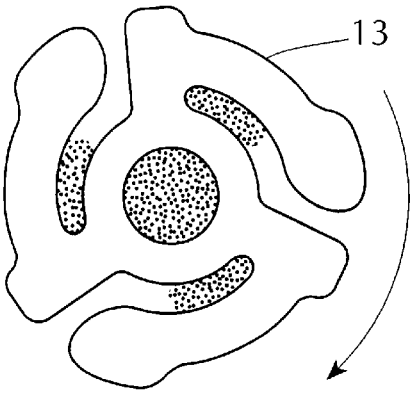
FIG. 5: illustrates how the hair styling device is rotated to provide a braid-like appearance to the hair.

FIG. 1 illustrates the device in accordance with the invention prior to its incorporation into a hair tress. FIG. 2 illustrates one method of using the device of the invention. The hair tress is divided into four segments. One segment is pulled through the central aperature 2 as illustrated in FIG. 4. A second hair segment is pulled through slit 5, a third hair segment throught slit 5*a,* and a third hair segment through slit 5*b* as illustrated in FIG. 4. The device is then rotated in a circle to cause the hair segments to form a braid-like configuration as illustrated in FIG. 5. If desired, the device is moved downward toward the ends of the hair as the device is rotated to cause the braid-like configuration to extend the length of the hair. After the desired length of hair is braided with the device, it is removed from the hair and the hair is bound by using clips, barrettes, bands, or the like to cause the braid to remain in the hair. The braided hair may be left as is, or it may be desired to apply compositions which cause temporary or permanent deformation of the hair.

Figure 6:
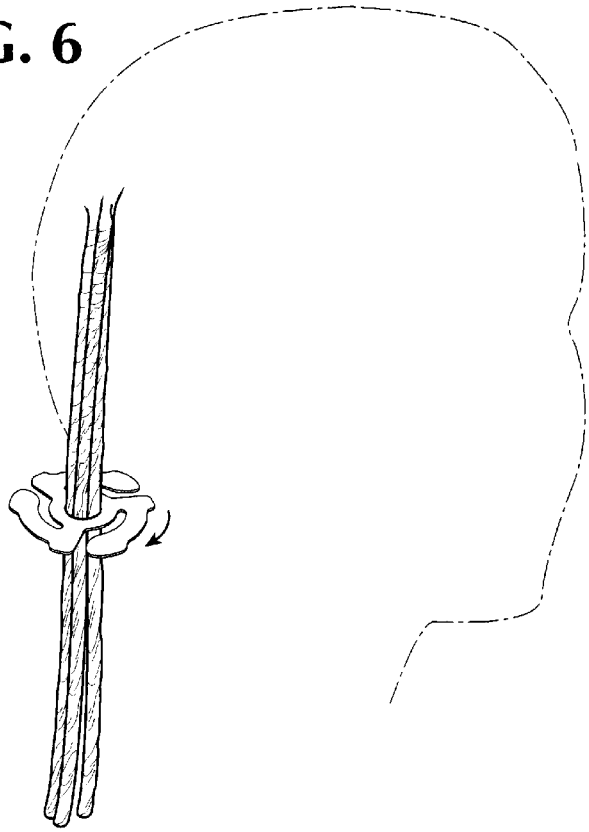
FIG. 6: illustrates another method of using the hair styling device where the complete tress is drawn through the central aperature of the hair styling device.
Figure 7:
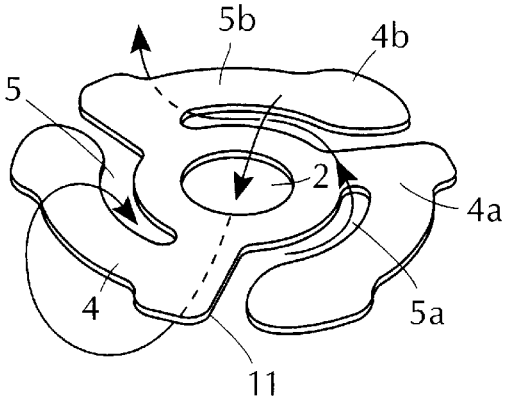
FIG. 7: illustrates one method of winding a hair tress through the hair styling device, the arrows indicating the direction in which the hair tress is wound.

FIG. 6 illustrates another method of using the hair styling device of the invention. A hair tress is pulled down through the central aperature 2 of the device. FIG. 7 illustrates one way in which the hair tress can be wound through the device. In particular, the tress is pulled down through the central aperature 2 and over arm 4, and threaded down through slit 5, and up through slit 5*a* and over arm 4*a*. The tress is then threaded down through slit 5*b* and under arm 4*b*.

Figure 8:
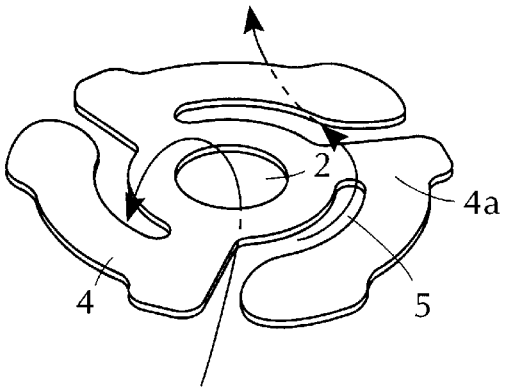
FIG. 8: illustrates another method of winding a hair tress through the hair styling device, the arrows indicating the direction in which the hair tress is wound.

FIG. 8 illustrates yet another method of winding a hair tress through the device of the invention. The tress is pulled up through the central aperature 2 and threaded down through slit 5, under and up through slit 5*a,* over arm 4*a,* and down through slit 5*b*.

Figure 9:
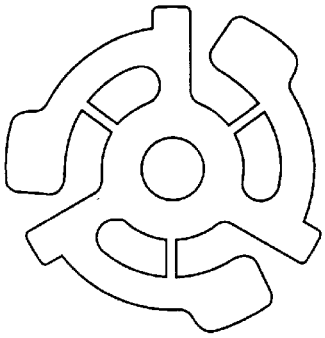
FIG. 9 PRIOR ART
FIG. 9: illustrates a standard record disk.

FIG. 9 illustrates a standard record disk which has been known for use in waving hair. It will be noted that the central aperature is quite small when compared to the device of the invention, thus permitting only a small tress of hair to be pulled through. Also, the protrusions of the disk are not considered "arms" because they are attached to the central core of the disk at both the shoulder and elbow areas. This configuration does not permit any hair to be pulled through the protrusions, or in the alternative, only small tresses of hair. The blunt edges also contribute to hair breakage.

Generally in styling hair using the devices of the invention, the entire head is segmented into sections, and each tress represented by a section is wound through the device as mentioned above. Each tress may be wound through the device in a manner identical to the method used for the other tresses, or it may be desired to vary the pattern of winding the tress through the device. The devices may be incorporated into wet or dry hair, depending on whether the hair is to be treated with compositions that cause temporary or permanent deformation of hair. Compositions which cause temporary deformation of hair are mousses, hairsprays, hair gels, and the like. For example, hair mousse or gel can be applied to wet hair. The wet hair is then segmented and wound onto the hair styling device of the invention and allowed to dry either naturally or by application of heat. When the hair is dry, the devices are removed.

Compositions such as permanent waving compositions cause permanent deformation of the hair, and are well known in the art. In the preferred embodiment of the invention, hair tresses are wound through the device as illustrated in FIGS. 7 and 8. Then a permanent wave composition such as a sodium bisulfite-based permanent wave composition is applied to the hair. It should be noted that the permanent wave compositions and methods used are widely available and well known in the art. The permanent wave composition is left on the hair for a period of time sufficient to cause the disulfide bonds of the hair to break and configure in the same manner in which the hair tress has been wound through the device of the invention. The devices are then removed from the hair and the hair exhibits a wavy appearance.

We claim:

1. A method for styling hair with a hair styling device comprised of a flat disk made of a flexible plastic material having a central core with a plurality of arms having free ends radiating therefrom, wherein one or more of said arms contain a slight bulge at the free end, wherein said central core contains an aperature of size sufficient to permit a tress of hair to pass therethrough, comprising the steps of:

a) pulling a tress of hair through the aperature of said central core, b) winding said tress through the arms radiating from said central core in a desired configuration, and c) leaving the device in the hair for a period of time sufficient to cause the hair to conform to the desired configuration.

2. The method of claim 1 wherein the hair is treated with a hair waving or hair styling composition prior to using the hair styling device.

3. The method of claim 2 wherein the hair styling composition is a mousse, hair styling gel, or hairspray.

4. The method of claim 1 wherein the aperature of the central core has a diameter of 0.25 to 0.75 inches.

5. A method for styling hair with a hair styling device comprised of a flat disk made of a flexible plastic material having a central core with a plurality of arms radiating therefrom, wherein one or more of said arms contain a slight bulge at the free end, and wherein said central core contains an aperature of size sufficient to permit a tress of hair to pass therethrough, comprising the steps of:

a) pulling a tress of hair through the aperature of the hair styling device, b) winding the tress through the arms radiating from the central core in the desired configuration, c) repeating steps (a) and (b) until the desired number of hair styling devices have been applied to the hair, d) applying a permanent wave composition to the hair and leaving it in the hair for a period of time sufficient to cause the hair to conform to the desired configuration.

6. The method of claim 5 wherein the permanent wave composition is a sodium bisulfate-based permanent wave composition.

7. The method of claim 6 wherein the hair styling device has three arms.

* * * * *